US005651308A

United States Patent [19]

Rohwetter et al.

[11] Patent Number: 5,651,308

[45] Date of Patent: Jul. 29, 1997

[54] APPARATUS FOR PRINTING ON INDIVIDUAL ARTICLES

[75] Inventors: Norbert Rohwetter, Bünde; Joachim Hellmeier, Rödinghausen, both of Germany

[73] Assignee: Werner Kammann Maschinenfabrik GmbH, Bünde, Germany

[21] Appl. No.: 541,839

[22] Filed: Oct. 10, 1995

[30] Foreign Application Priority Data

Oct. 11, 1994 [DE] Germany ..... 44 36 275.7

[51] Int. Cl.[6] ..... B41F 17/08

[52] U.S. Cl. ..... 101/40.1; 101/35; 101/38.1; 101/123

[58] Field of Search ..... 101/35, 38.1, 40, 101/39, 40.1, 123, 124

[56] References Cited

U.S. PATENT DOCUMENTS

| | | | |
|---|---|---|---|
| 3,253,538 | 5/1966 | Rudolph et al. | 101/40 |
| 3,863,753 | 2/1975 | Shank, Jr. | 101/40 |
| 4,048,914 | 9/1977 | Kammann et al. | 101/35 |
| 4,109,573 | 8/1978 | Strauch et al. | 101/38 R |
| 4,164,279 | 8/1979 | Dubuit | 198/492 |
| 4,254,706 | 3/1981 | Lala | 101/38 R |
| 4,398,627 | 8/1983 | Saccani | 198/339 |
| 4,502,380 | 3/1985 | Meador | 101/38 R |
| 4,567,822 | 2/1986 | Heidenreich et al. | 101/38 A |
| 4,592,277 | 6/1986 | Dennesen et al. | 101/38 R |
| 4,781,112 | 11/1988 | Cohan | 101/38 A |
| 4,787,310 | 11/1988 | Tiemann | 101/40 |
| 4,862,798 | 9/1989 | Motev | 101/40.1 |
| 5,120,392 | 6/1992 | Butkevich et al. | 101/40.1 |
| 5,207,156 | 5/1993 | Helling | 101/38.1 |
| 5,317,967 | 6/1994 | Heidenreich | 101/38.1 |
| 5,524,535 | 6/1996 | Strutz et al. | 101/38.1 |

FOREIGN PATENT DOCUMENTS

| | | |
|---|---|---|
| 690386 | 2/1967 | Belgium . |
| 0 121 486 A2 | 10/1984 | European Pat. Off. . |
| 0 516 968 | 9/1992 | European Pat. Off. . |
| 0 266 645 | 5/1988 | Germany . |
| 37 30 409 A1 | 3/1989 | Germany . |
| 3936157 | 5/1991 | Germany . |
| 0-535 512 | 7/1993 | Germany . |
| 41 32 668 C2 | 9/1993 | Germany . |
| WO-87/02623 | 5/1987 | WIPO . |
| WO 95/22458 | 8/1995 | WIPO . |

*Primary Examiner*—Christopher A. Bennett
*Attorney, Agent, or Firm*—Seidel, Gonda, LaVorgna & Monaco, PC

[57] ABSTRACT

An apparatus for printing on individual articles has at least two rotatably disposed holders, each of which carries an article. Each of the holders which can comprise first and second holder portions is provided with separate drives for transporting the respective holder and for producing rotational movement thereof so that an article carried by one of the holders can be moved and rotated independently of articles carried by other holders. When printing on articles whose region to be printed upon differs from the shape of a circle or a circular arc, it is also possible for the printing mechanism consisting of a screen printing stencil and a squeegee to be raised or lowered in the printing operation, in dependence on the cross-sectional shape of the region to be printed upon, so that there is no need to alter the position in respect of height of the article during a printing operation.

13 Claims, 12 Drawing Sheets

151
142
140
159
121
145
131
132
115
116
115
128
125
109
114a
171b
112a
143b
126
185a
141
122
171a
139
148b
119
183a
146b
164b
143a
171a
148a
171b
168a
164a
189b
170
162a
195b
138
150a
189a
150b
191a
146a
195b
195a
196a
195a
144a
144b

APPARATUS FOR PRINTING ON INDIVIDUAL ARTICLES

FIELD OF THE INVENTION

The invention concerns a process and an apparatus for printing on individual articles using the screen printing process.

BACKGROUND OF THE INVENTION

It is known from European patent specification No 0 121 486 for processes for printing on individual articles by a screen printing procedure to be effected using program-controlled individual NC-drives. That publication in particular also discloses the relative movements which are performed by the parts which co-operate in the printing operation, that is to say more particularly the article itself, the screen printing stencil and the squeegee of the printing mechanism, while also disclosing how the resulting movements arise out of the motion components associated with a conventional co-ordinate system. This consideration applies in particular in regard to applying printing to articles whose portion, to which the printing is to be applied, differs in cross-section from the shape of a circular arc with a single central axis. The disclosure of that publication is hereby incorporated as appropriate into the content of the present application.

In another form of screen printing machine, as is to be found in German laid-open application (DE-OS) No 37 30 409, the machine has a number of separate, co-ordinatedly controllable drive motors for producing the movement of the individual members, in particular a holder for holding the article to be printed upon, and the screen carrier of the mechanism. The machine has a single holder which is mounted reciprocably at the front side of the machine. That machine has only a low level of productivity as it has only a single holder which is additionally movable beyond the printing region in which printing is applied to the article, to a feed conveyor on one side of the machine and to a discharge conveyor on the other side. The consequence of this is that, after termination of the last printing operation and possibly after drying, the article must firstly be removed from the holder before the holder can then be moved back into its starting position in order there to receive the next article. Particularly in the case of apparatuses which have a plurality of printing stations for applying for example a print image consisting of a plurality of colors or inks, that low level of productivity of this apparatus makes itself particularly clearly felt.

SUMMARY OF THE INVENTION

An object of the present invention is to provide a program-controlled screen printing machine such that it is possible to achieve therewith a higher production rate without a need for that purpose to increase the number of printing stations.

Another object of the present invention is to provide an apparatus for printing on an article which affords accurate co-ordination of the relative movements of the parts which co-operate in the printing operation, in order to achieve a high quality of print.

Still another object of the present invention is to propose a process for decorating individual articles using a simple and accurately controllable printing procedure.

Yet another object of the present invention is to provide a screen printing process which affords a high degree of versatility in terms of the printing procedure to be performed in the process and the kind of article to be printed upon.

In accordance with the present invention the foregoing and other objects are achieved by an apparatus which has at least two holders for the articles and a separate transport means is provided for each holder, each transport means for a holder being driven by a separate NC-motor. The transport means transports the associated holder preferably along a closed path of circulatory movement between a station in which the article to be printed upon is introduced into the holder, and a station in which the printed article is removed from the holder, wherein if necessary the transport means in the individual printing stations also transmits to the holder the linear movements which are required during the printing operation in order that the article to be printed upon and the squeegee of the printing mechanism are held in the relative position with respect to each other, which is required for the respective printing operation.

By virtue of the fact that each holder has its own, separately driven transport means which in accordance with an advantageous feature of the invention is in the form of a circulating toothed belt, it is now possible for all holders to be controlled independently of each other, in regard to transportation movement thereof, so that the one holder with the article carried thereby passes for example through a plurality of printing stations which are arranged in succession in the transportation direction whereas another holder, independently thereof, can be introduced into the station in which the printed article is removed from the holder and thereafter can possibly be immediately moved again into the article-receiving station in order there to receive the next article, without being dependent on the transportation steps or the speed of transportation-movement of the at least one other holder. The use of separate transport means with separate drives also has the advantage that the degree of accuracy with which the holder and thus the article carried thereby perform the linear movements required in the printing operation is substantially higher than it could be, if a common transport means and a common drive were provided for a plurality of holders.

In accordance with a further feature of the invention a separate transmission means can be provided for each holder; the rotary movements which the holder and thus the article carried thereby perform during the printing operation can thus be transmitted to the holder by way of the transmission means. Desirably in this respect also the transmission means includes a toothed belt which is in engagement with a toothed belt wheel connected to the holder. The drive for the individual transmission means is also produced by way of separate NC-motors, with the result that the pivotal or rotational movements of the holders during the printing operation can be performed with a high degree of accuracy in order to achieve the desired high print quality. That is particularly important when printing is to be applied to articles which are of an irregular cross-sectional shape.

In the case of articles, such as for example bottles, which, by virtue of their shape, are normally held at both ends, for example their bottom end and their neck end, during the printing operation or when other treatment operations are being carried out in the apparatus, the holder comprises first and second holder portions which are moved synchronously. In this case the arrangement is such that each holder portion is transported by a separate toothed belt, and the apparatus further has a separate toothed belt for each holder portion in order to transmit to the held article the rotational movements which are required during the printing operation. In that respect, a common NC-motor is associated with each of the two toothed belts for the transport movement and with each of the two toothed belts for transmission of the rotational movements.

It will be appreciated that it is also possible to use one-part holders if the shape of the article requires that or makes that possible.

At any event the configuration of the apparatus according to the invention provides that the respective masses to be moved are comparatively small. That is of benefit in terms of the degree of accuracy of the printing procedure and thus the quality of the print image.

Furthermore, the use of respectively individually driven individual transport means and individual transmission means affords if necessary the possibility of transmitting to an article movements which are independent of the movements which are being performed by other articles in the apparatus. As a result, in those situations in which the printing mechanisms in the printing stations are actuable and controllable independently of each other, it is possible for the individual printing stations simultaneously to perform printing operations which require different movements of the co-operating parts.

In addition the screen printing stencil and the squeegee of the at least one printing mechanism can be synchronously movable up and down so that, when dealing with articles of an irregular shape, it is possible to compensate for the vertical movements of the region of the article to be printed upon, such movements occurring in the printing operation. In that case, there is no need for the article to perform a vertical movement in the printing operation. The arrangement therefore always has at least four program-controlled drives, the movements of which must be co-ordinated with each other.

In a further aspect of the present invention the foregoing and other objects are achieved by a screen printing process for decorating individual articles, as set forth herein.

Further objects, features and advantages of the present invention will be apparent from the following description of preferred embodiments thereof.

DESCRIPTION OF PREFERRED EMBODIMENTS

Figure 1:
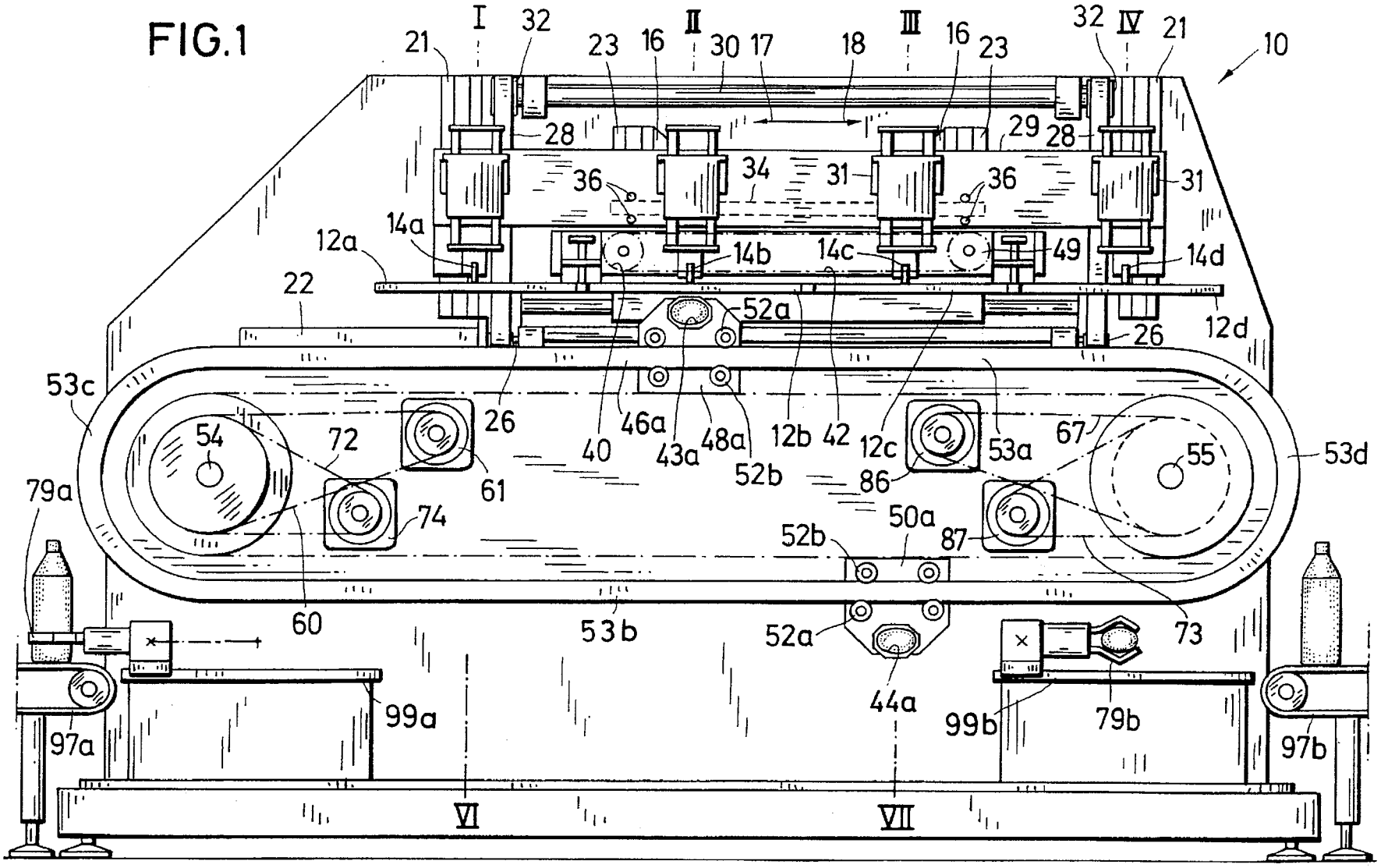
FIG. 1 is a front view of an apparatus according to the invention in the form of a screen printing machine for printing on articles.

Referring firstly to FIGS. 1 through 7, reference numeral 10 therein generally identifies an apparatus for printing on an article, in accordance with the invention, in the form of a screen printing machine having first, second, third and fourth printing stations I, II, III and IV, each of which has a screen printing stencil 12*a*, 12*b*, 12*c*, 12*d* each with an operatively associated squeegee or doctor 14*a*, 14*b*, 14*c*, 14*d*. The machine 10 is provided with a base slide or carriage 16 which is reciprocable horizontally in the direction of arrows 17 and 18, on guides 15 mounted on the machine frame structure 19. At both ends the base carriage 16 is provided with two vertical guides 23. It can be seen from FIG. 1 that the base carriage 16 is of smaller height in the region between the two vertical guides 23 than in the two end regions which have the guides 23, to save weight. A respective slide or carriage 25 is vertically movably guided on each of the two guides 23. At their side remote from the base carriage 16, the two carriages 25 carry an elongate carrier 27 on which all screen printing stencils 12*a*–12*d* are mounted.

Moreover, in the region of the outer printing stations I and IV the screen printing machine 10 is provided with vertical guides 21 which are mounted directly on the machine frame structure 19. A carriage 20 is guided on each of those guides 21. Fixed to the two carriages 20 is an elongate carrier 29 on which all squeegees 14*a*–14*d* are mounted by way of cantilever arms indicated at 31 for example in FIG. 2.

At its side remote from the squeegees, a substantially horizontal rail 34 is fixed to the carrier 29. Two pairs of rollers 36 bear against the rail 34, at the top and bottom side. As FIG. 2 in particular shows, the pairs of rollers 36 are mounted on respective ones of the carriages 25 which are movable up and down along the guides 23.

Figure 2:
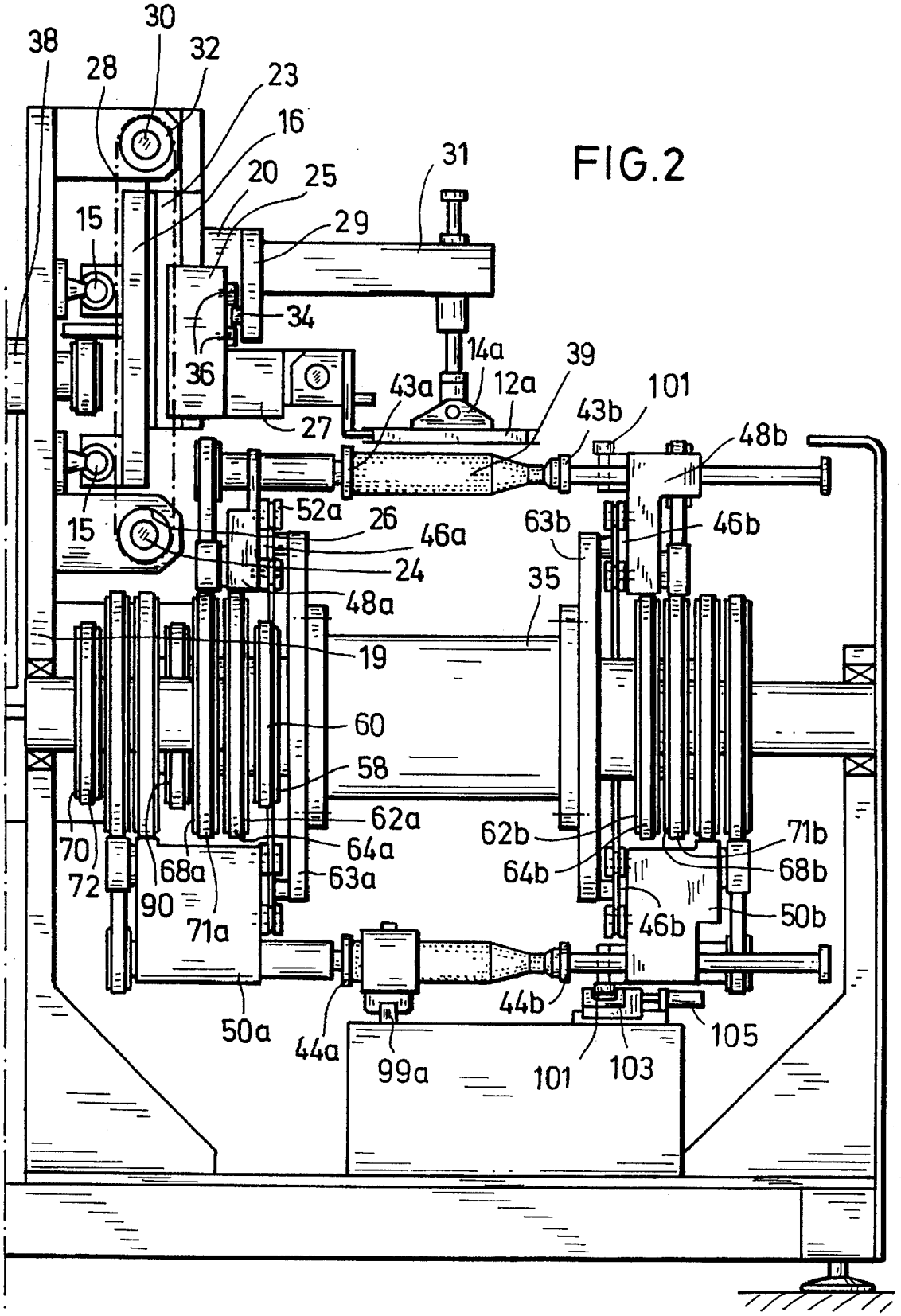
FIG. 2 is a side view of the FIG. 1 structure.
Figure 3:
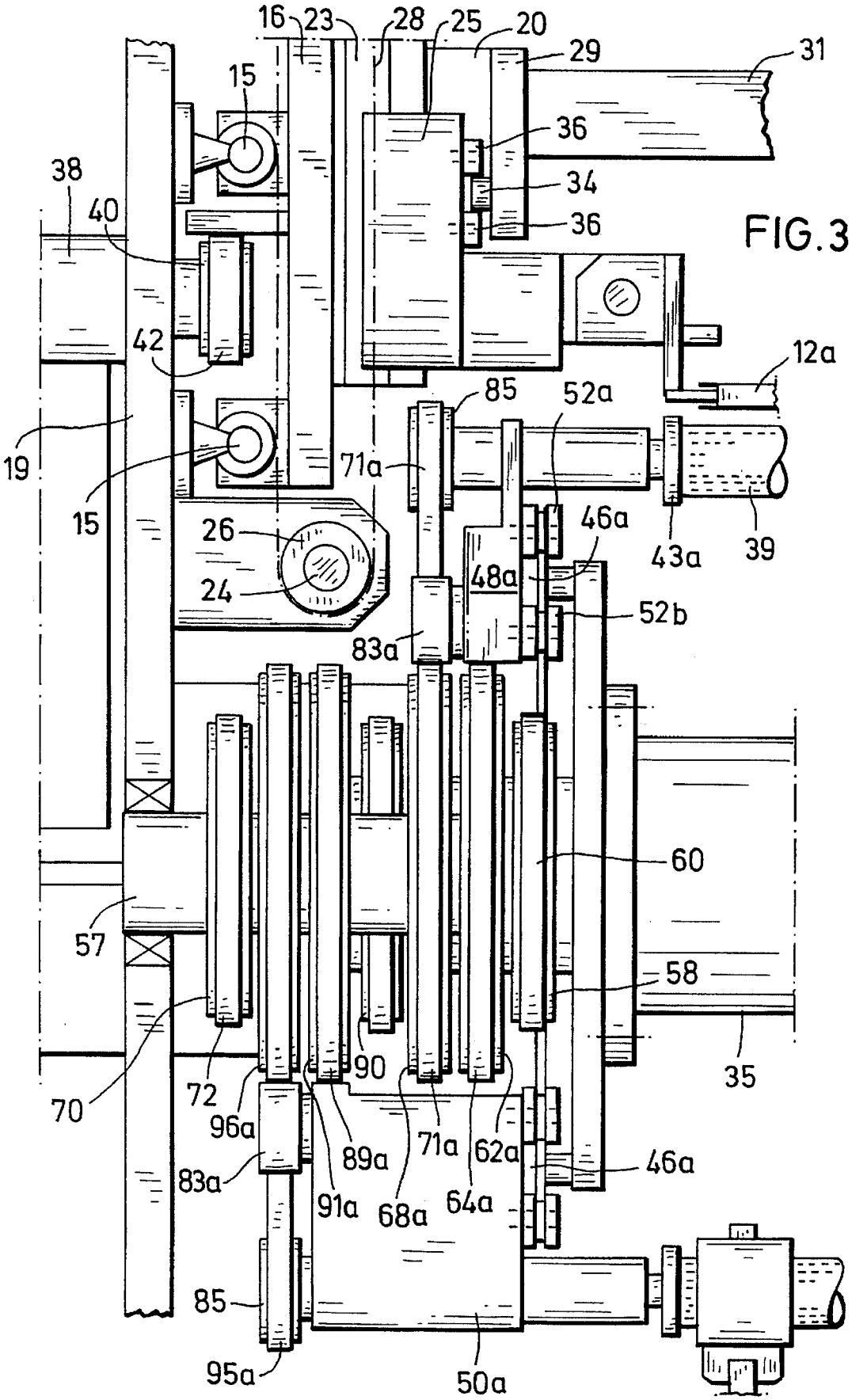
FIG. 3 shows a portion of the structure shown in FIG. 2 on a larger scale.

The reciprocating movements of the base carriage 16 in the direction of the arrows 17, 18 are produced by an NC-motor diagrammatically indicated at 38 for example in FIGS. 2 and 3, driving a toothed belt wheel 40 engaging with a toothed belt indicated at 42 for example in FIG. 1. The toothed belt 42 is also guided around a second toothed belt wheel indicated at 49 in FIG. 1. The toothed belt 42 is connected to the base carriage 16 so that the latter and therewith the guides 23 as well as the screen printing stencils 14*a*–14*d* connected to the base carriage 16 by way of the carriages 25 and the carriers 27 can be reciprocated in the direction of the arrows 17, 18 by suitable actuation of the NC-motor 38. The vertical movements of the printing mechanisms are produced by an NC-motor indicated at 22 in FIG. 1 driving a shaft 24 (shown in FIG. 2) on which are fixed two toothed belt wheels 26 each engaging with a toothed belt 28. Mounted on the machine frame structure 19 above the vertical guides 21 is a further shaft 30 to which two toothed belt wheels 32 are fixed, each of which serves to guide one of the toothed belts 28. Each of the two toothed belts 28 is connected to one of the two carriages 25 so that, by means of actuation of the motor 22, the carrier 27 for the screen printing stencils 12*a*–12*d* and synchronously therewith by way of the connection between the rail 34 and the pairs of rollers 36, also the carrier 29 with the squeegees 14*a*–14*d* mounted thereon are moved, the carrier 29 being guided by way of the carriages 20 on the laterally arranged guides 21. In the structure shown in FIGS. 1 and 2 the squeegees do not participate in the reciprocating movements in the direction of the arrows 17 and 18; the connection by way of the rail 34 and the pairs of rollers 36 permits a relative movement as between the arrangement carrying the squeegees and the arrangement carrying the screen printing stencils.

Disposed beneath the screen printing stations I–IV is a transport path along which the articles 39 to be printed are passed stepwise through the individual treatment and printing stations I–IV. As the screen printing machine is provided with four printing stations, four print images are normally successively applied to the respective article, so that the successively applied print images can combine to form the overall print image. It is however also possible to adopt a procedure whereby for example on the same region of the surface of the article, two print images which combine to form an overall print image are successively applied for example in stations I and II, and for example in printing stations III and IV, two further print images which combine to form an overall print image are applied to another region of the surface of the article. The respective procedure involved in applying the individual print images and the possible combinations are aspects which are familiar to any man skilled in the art in this respect so that they do not need to be especially described herein.

In the direction of transportation movement as indicated by the arrow 18 of the articles, downstream of each printing station, there may be a device by means of which the printing ink that has just been applied can be dried. In many cases this involves an UV-radiating device. These matters are also familiar to any man skilled in the art here so that they do not need to be described in greater detail herein. For reasons of enhanced clarity of the drawing the drying devices such as UV-radiating devices are not shown in the drawing.

While it is being transported through the machine 10, each article is carried by a holder. In all, the illustrated machine 10 has two holders which are transported and rotated independently of each other.

As the printing machine 10 illustrated by way of example of the invention in the drawing serves for printing on articles which are in the form of bottles and which are thus held at both ends thereof, each holder in the illustrated embodiment comprises first and second holder portions 43*a*, 43*b* and 44*a*, 44*b* respectively, of which the respective holder portions 43*a* and 44*a* receive the bottom portion of the article or bottle 39 in the usual manner whereas the holder portion 43*b* and 44*b* respectively, which is of a mandrel or bar-like configuration, engages into the neck of the respective bottle.

The path of transportation movement for the holders 43*a*, 43*b* and 44*a*, 44*b* and the articles carried thereby is defined by a pair of rails 46*a* and 46*b* which extend in a closed circulatory configuration and on which the holders are guided.

The holder portions 43*a*, 43*b*; 44*a*, 44*b* are carried by transport carriages 48*a*, 48*b* and 50*a*, 50*b* respectively which co-operate in pairs in accordance with the function of the holder portions. Thus the holder portions 43*a*, 43*b* are mounted on the carriages 48*a* and 48*b* respectively while the holder portions 44*a*, 44*b* are carried by the carriages 50*a* and 50*b* respectively. Each of the above-mentioned carriages is provided with two rollers 52*a*, 52*b* which are arranged in pairs and which are disposed at a spacing from each other corresponding to the height of the respective rail 46*a*, 46*b*, and, by bearing against the respective rail 46*a*, 46*b*, serve to guide the respective carriage on the rail.

The two rails 46*a* and 46*b* are arranged to extend in a circulatory configuration in a vertical plane so that they provide an upper, substantially horizontal transport path portion 53*a* and a lower transport path portion 53*b* which is disposed vertically below and substantially parallel to the transport path portion 53*a*, while the two transport path portions 53*a*, 53*b* are connected together at their mutually facing ends by respective transport path portions 53*c* and 53*d* which are approximately of a semicircular configuration. Arranged in each of those two semicircular transport path portions 53*c*, 53*d* is a respective substantially horizontally extending set of shafts 54, 55 which are each coaxial with respect to the respective transport path portions 53*c*, 53*d*. In that connection, the shaft set 54 which is at the left in the view in FIG. 1 is associated with the pair of carriages 48*a* and 48*b* while the right-hand shaft set 55 is associated with the pair of carriages 50*a* and 50*b*.

For transportation of the holder 43*a*, 43*b* the shaft set 54 has a shaft as indicated at 57 in FIG. 3 on which a coaxial shaft 56 is rotatably mounted, a toothed belt wheel 58 being fixedly connected to the shaft 56. The wheel 58 is driven by an NC-motor indicated at 61 in FIG. 1 by way of a toothed belt 60. Also fixedly mounted on the shaft 56 are two toothed belt wheels 62*a*, 62*b* which each drive a respective toothed belt 64*a*, 64*b*. Each of those toothed belts 64*a*, 64*b* is guided over a respective toothed belt wheel 66*a*, 66*b* which is loosely arranged on the right-hand shaft 55, in such a way that the belt extends parallel to the rails 46*a*, 46*b*.

The endless toothed belt 64*a* which passes around the toothed belt wheels 62*a*, 66*a* is connected to the carriage 48*a* carrying the holder portion 43*a*. The endless toothed belt 64 passing around the toothed belt wheels 62*b* and 66*b* is connected to the carriage 48*b* for the holder portion 43*b*. Thus, transportation movement of the article carried by the holder portions 43*a*, 43*b* along the guide path defined by the rails 46*a* and 46*b* can be produced and controlled by actuation of the motor 61.

As the portion of the bottle-shaped article, to which printing is to be applied, must be rolled against the screen printing stencil during the printing operation, for the purposes of transmitting the movements required for that purpose to the article, a toothed belt wheel 70 is fixedly connected to the shaft 57 which is drivable by an NC-motor 74 by way of a toothed belt 72. Two toothed belt wheels 68*a*, 68*b* are further fixedly connected to the shaft 57. Each of those two toothed belt wheels drives a respective toothed belt 71*a*, 71*b* which is also guided over a respective toothed belt wheel 75*a*, 75*b* arranged loosely on the right-hand shaft 55. The endless toothed belt 71*a* is associated with the carriage 48*a* and is passed through same. For that purpose the carriage 48*a* is provided with two guide rollers 83*a* and 83*b* over which the toothed belt 71*a* runs with its smooth side. A toothed belt wheel 85 which is mounted on the carriage and which is driven by the toothed belt 71*a* is fixedly connected to a shaft 84 carrying the holder portion 43*a*. Accordingly actuation of the NC-motor 74 results in corresponding rotary movement of the holder portion 43*a* and therewith the article carried thereby. A rotary movement of that kind can also be produced by mere displacement of the carriage 48*a* along its transport path defined by the rail 46*a*, while the toothed belt 71*a* is stationary. When the carriage is moving along the guide path therefore, the rotational movement of the article carried by the holder portion 43*a* would result from that transport movement and a movement of the toothed belt wheel 71*a* which possibly takes place at the same time.

The above-described arrangement of the parts and the cooperation thereof apply in a corresponding manner in relation to the toothed belt 71*b* and the carriage 48*b* carrying the associated holder portion 43*b*. Because the toothed belt wheels 62*a*, 62*b* and 68*a*,68*b* respectively are rigidly connected to each other and fixedly connected to the respective drive toothed belt wheel 58 and 70 respectively, that arrangement ensures absolute synchronism of the movements of the two carriages 48*a*, 48*b* and therewith the holder portions 43*a*, 43*b* carrying the respective article.

The two carriages 50*a*, 50*b* of the holder 44*a*, 44*b*, which carriages are shown in a lower position in the drawing in FIG. 1, are driven in a corresponding manner by way of the shaft set 55 shown at the right in FIG. 1. Associated with the shaft set 55 the apparatus also has two NC-motors 86, 87 of which the metor 86 serves for transport of the two carriages 50*a*, 50*b* along the guide path defined by the two rails 46*a*, 46*b* while the motor 87 produces the drive for the holder portions 44*a*, 44*b* for rotation of the article carried thereby. Rotatably mounted on the shaft indicated at 77 in FIG. 4 of the shaft set 55 is a coaxial shaft 78 to which a plurality of toothed belt wheels are fixedly connected. A toothed belt wheel 90 is driven by the NC-motor 86 by way of a toothed belt 67. Also fixedly mounted on the shaft 78 are two toothed belt wheels 88*a*, 88*b* which each drive a respective toothed belt 89*a*, 89*b*. Each of the toothed belts 89*a*, 89*b* is so guided over a toothed belt wheel 91*a*, 91*b* which is loosely mounted on the left-hand shaft 57, that it extends parallel to the rails 46*a*, 46*b*. Both toothed belts 89*a*, 89*b* are respectively connected to one of the carriages 50*a*, 50*b* in order to transport sane along the guide path defined by the rails 46*a*, 46*b*.

Fixedly connected to the shaft 77 is a toothed belt wheel 92 which is drivable by the NC-motor 87 by way of a toothed belt 73. Two toothed belt wheels 94*a*, 94*b* are also fixedly connected to the shaft 77. Each of those two wheels 94*a*, 94*b* drives a toothed belt 95*a*, 95*b* which is also guided over a toothed belt wheel 96*a*, 96*b* arranged loosely on the left-hand shaft 57. The toothed belt 95*a* is associated with the carriage 50*a* and is passed through the carriage 50*a* in the manner already described in connection with the toothed belt 71*a* and the carriage 48*a*. The toothed belt 95*b* is associated with the carriage 50*b* in a corresponding manner. The two toothed belts serve to produce the rotational movement of the article carried by the holder 44*a*, 44*b*, such movement being required in the printing operation or in other treatment operations to be performed on the article.

Figure 4:
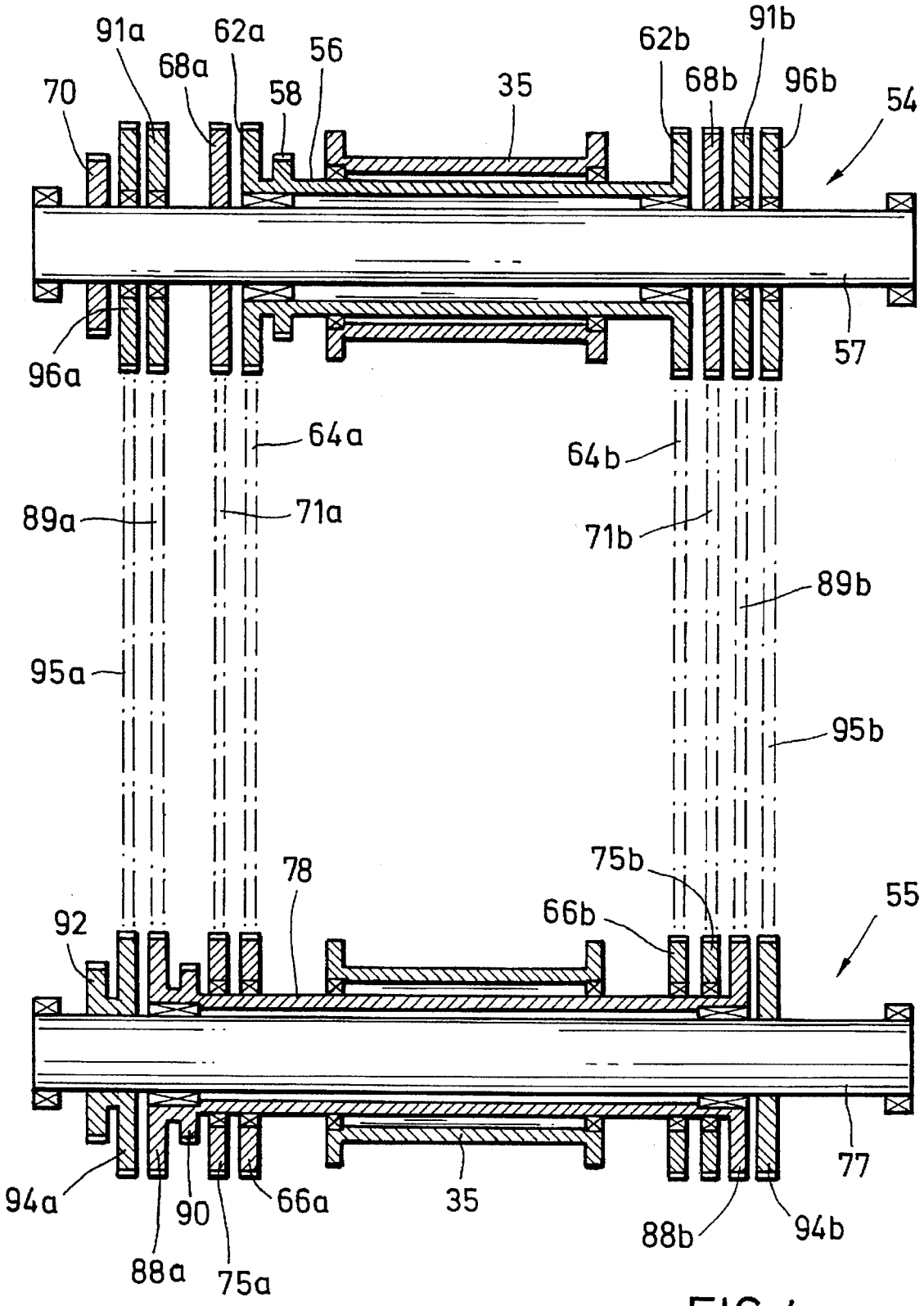
FIG. 4 is a diagrammatic view showing the arrangement of components for producing transportation and drive of the articles.
Figure 5:
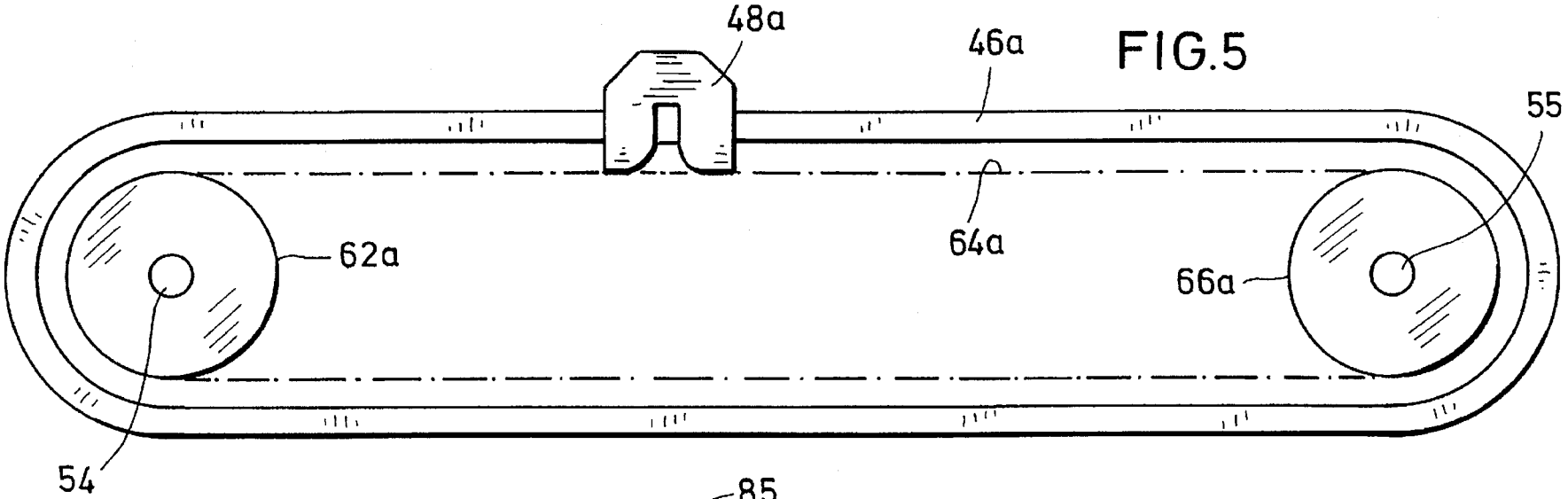
FIG. 5 is a diagrammatic view of a detail of the arrangement for transporting the articles.
Figure 6:
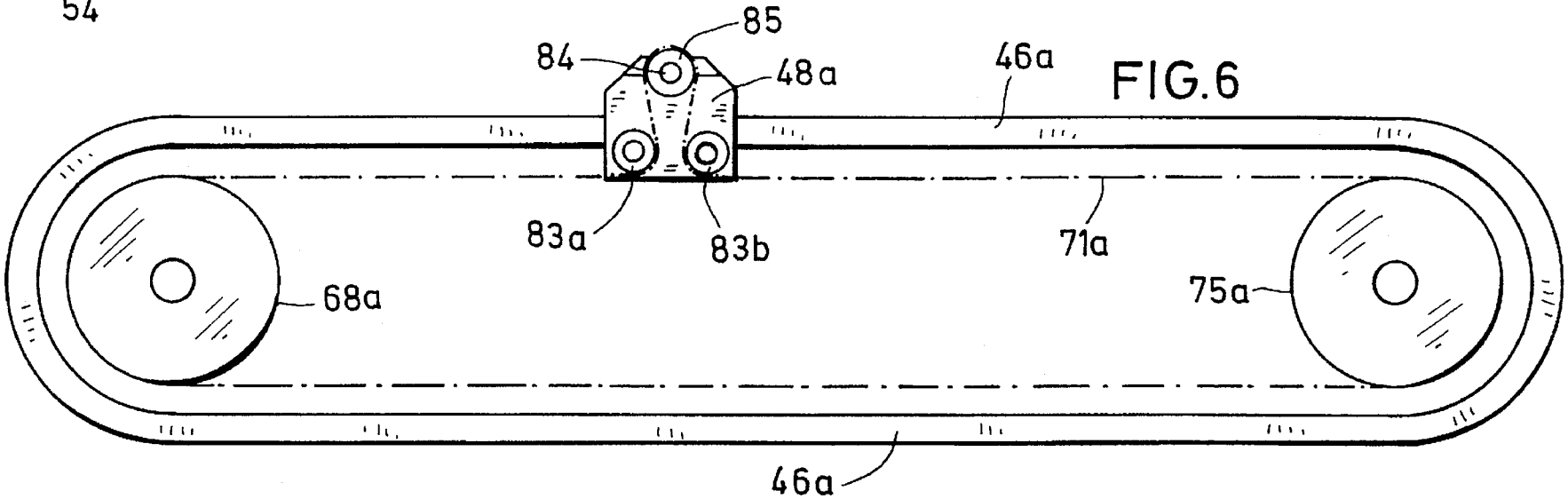
FIG. 6 is a view corresponding to FIG. 5 of a detail of the drive for the articles.

In addition the two shaft sets 54, 55 carry stationary carriers indicated at 35 in FIGS. 2 and 4, with the interposition of suitable bearings (shown but not referenced). Mounted at the axial ends of the two carriers 35 which do not participate in the rotary movement of the shafts 58, 78 of the two shaft sets 54, 55 are holding means indicated at 63*a*, 63*b* in FIG. 2 which carry the guide rails 46*a*, 46*b*.

It has already been mentioned hereinbefore that, when printing on an article whose region to which printing is to be applied differs in respect of its cross-sectional shape from a circular shape or the shape of a circular arc, the article, in dependence on the cross-sectional shape of its region to be printed upon, experiences a displacement transversely to its longitudinal axis, whereby it is ensured that the region of the surface of the article to which a respective printing ink is transferred by a squeegee in the course of a printing operation—that region hereinafter being referred to for the sake of brevity as the 'transfer region' extends substantially tangentially relative to the screen printing stencil and the squeegee is always substantially perpendicularly over the central axis of the transfer region and should thus represent the prolongation of the vertical radius of said transfer region. As, when dealing with a body which is for example of an elliptical shape, in the peripheral direction of the surface to be printed upon, the individual portions of said surface involve different curvatures and thus different central axes, continuous displacement of the article perpendicularly to its longitudinal axis may be necessary in order to satisfy the above-mentioned conditions, namely the transfer region must extend tangentially relative to the screen printing stencil and the squeegee must be positioned substantially perpendicularly above the central axis of the transfer region.

Figure 7A:
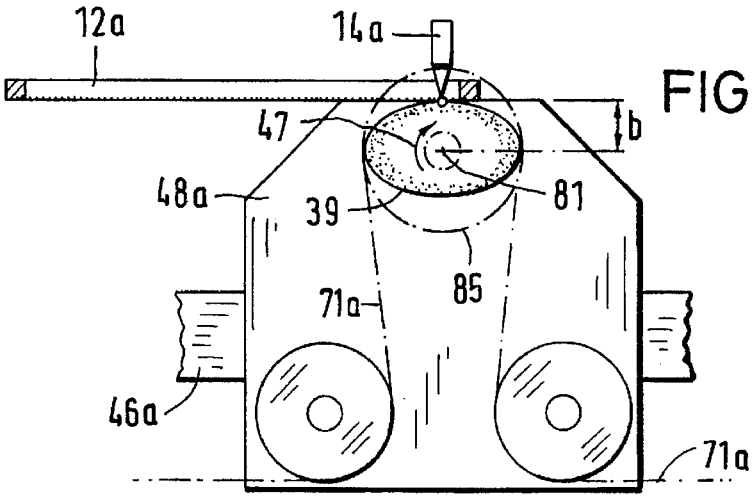
FIGS. 7*a–i* show the operating procedure involved in the printing process.

Reference will now be made more specifically to FIGS. 7*a*–*i* to illustrate the operating procedure involved in printing on an article which is of an elliptical cross-section, over its entire periphery of 360°. In that procedure the screen printing stencil 12*a* is reciprocable in the X-direction and the squeegee 14*a* is arranged stationarily in the X-direction. For the sake of simplicity FIGS. 7*a*–*i* only show the contour of the article 39 carried by the holder portions 43*a*, 43*b* (not shown here) which are transported by the program-controlled NC-motor 61 and by way of the toothed belts 64*a*, 64*b* into the position shown in FIG. 7*a* illustrating the positions of the co-operating parts at the beginning of the printing operation. The screen printing stencil 12*a* which is reciprocable both in the direction of the X-axis and also in the direction of the Y-axis assumes its starting position for the printing operation, which coincides with its left-hand limit position. The article 39 assumes a position in which its longer cross-sectional axis extends horizontally and the squeegee 14*a* is disposed vertically above the shorter cross-sectional axis of the article, in a position of prolongation thereof, and is thus disposed vertically above the longitudinal axis 81 of the cross-section which in this position of the parts is at the same time also the longitudinal axis of the transfer region. In other words, in this position of the parts the longitudinal axis 81 of the cross-section of the article and the longitudinal axis of the transfer region coincide. The spacing between the longitudinal axis 81 and the screen printing stencil 12*a* is indicated by 'b' in FIG. 7*a*.

Figure 7B:
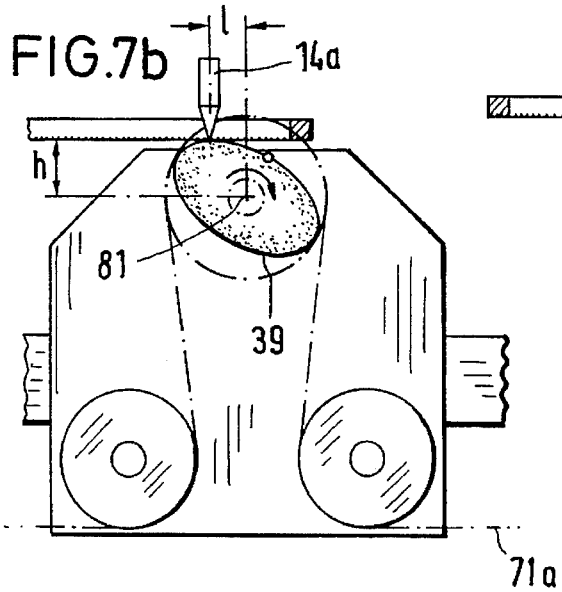

With the beginning of the printing operation the article is pivoted in the direction of the arrow 47 about its longitudinal axis 81 by the program-controlled NC-motor 74, by way of the toothed belts 71*a*, 71*b*. When that movement occurs, the screen printing stencil 12*a* is displaced towards the right in the direction of the X-axis by the program-controlled NC-motor 38 and at the same time is lifted with the squeegee 14*a* in the direction of the Y-axis by the program-controlled NC-motor 22 in order thereby to take account of the fact that, because of the elliptical cross-sectional shape of the article 39 or more specifically the region thereof to which printing is to be applied, the transfer region at the peripheral surface of the article which is provided with printing ink by the squeegee continuously moves upwardly in the course of the pivotal movement of the article. FIG. 7*b* shows an intermediate stage in the course of the printing operation in which the two axes of the cross-section extend inclinedly. During the pivotal movement which the article 39 has experienced hitherto, the central axis 81 has been displaced by the distance indicated at 'l' in FIG. 7*b* in the direction of the X-axis relative to the squeegee 14*a* which is stationary in the direction of the X-axis. The displacement of the holder 43*a*, 43*b* which is necessary for that purpose, in the direction of the X-axis, is also produced by the suitably programmed NC-motor 61 which drives the toothed belts 64*a*, 64*b*. The spacing between the central axis 81 and the screen printing stencil in the intermediate position shown in FIG. 7*b* is denoted by 'h'.

Figure 7C:
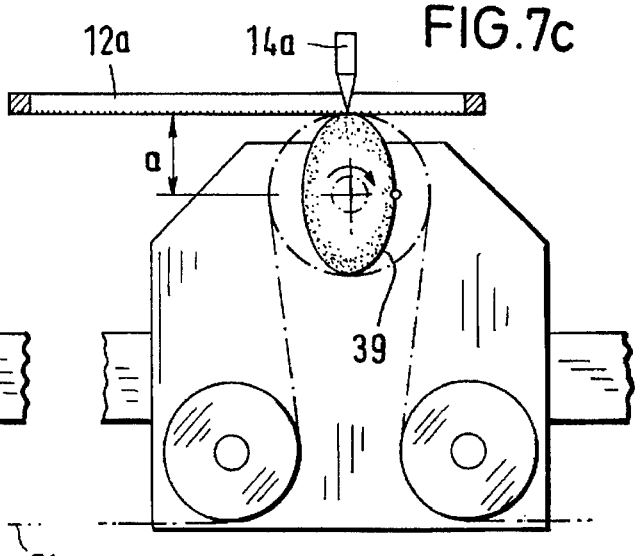

FIG. 7*c* shows the relative positions of the co-operating parts at a moment in time at which the longer axis of the cross-section of the article extends vertically and the squeegee 14*a* is disposed in a position of prolongation of that axis, perpendicularly above the center point of the cross-section, so that the longitudinal axis 81 of the article and the longitudinal axis of the transfer region again coincide. Thus, in the course of the pivotal movement from the position shown in FIG. 7*b* into the position shown in FIG. 7*c*, the carriages 48*a*, 48*b* with the holders 43*a*, 43*b* thereon are moved back again by the distance 'l' into the starting position shown in FIG. 7*a*. In addition the printing mechanism consisting of the screen printing stencil 12*a* and the squeegee 14*a* is further raised to the spacing 'a' indicated in FIG. 7*c* to take account of the fact that the transfer region of the article in the position shown in FIG. 7*c* is higher than in the position shown in FIG. 7*b*.

Figure 7D:
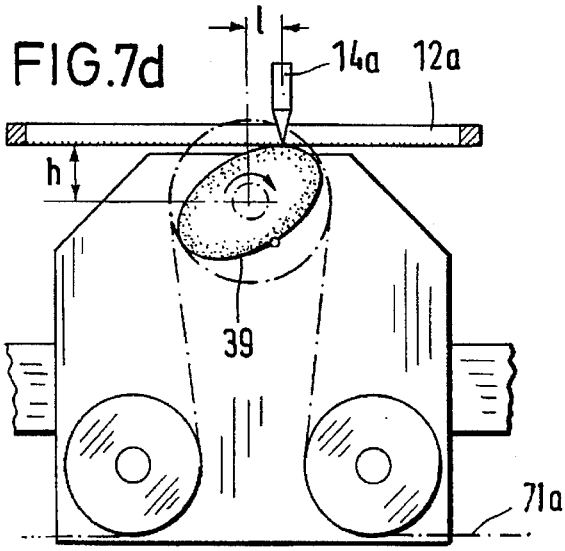

In the course of the further pivotal movement into the position shown in FIG. 7*d* there is a further lateral displacement of the article 39 in order to maintain the above-described position of the squeegee 14*a* relative to the surface region of the article, to which printing is to be applied, but this time the movement is in the opposite direction and therefore towards the left. The distance 'l' shown in FIG. 7*d* corresponds to the distance 'l' shown in FIG. 7*b* as in both cases the article assumes substantially the same angular position relative to the screen printing stencil, but in the opposite direction. The printing mechanism has been lowered somewhat in FIG. 7*d* relative to the position shown in FIG. 7*c*, corresponding to the position in respect of height of the transfer region of the article.

Figure 7E:
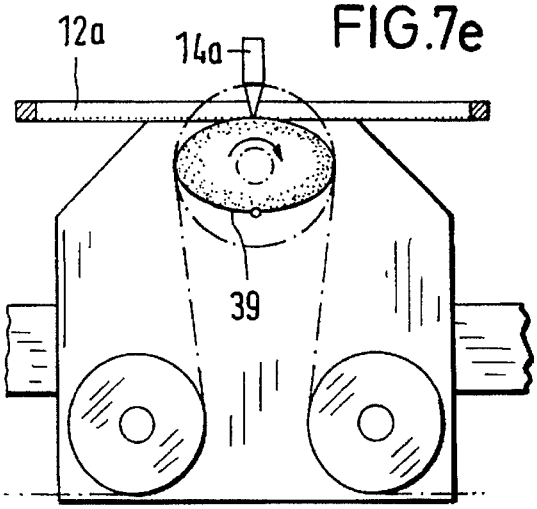
Figure 7F:
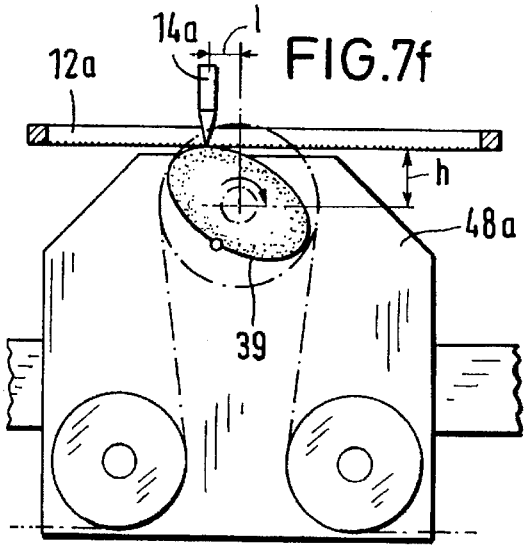
Figure 7G:
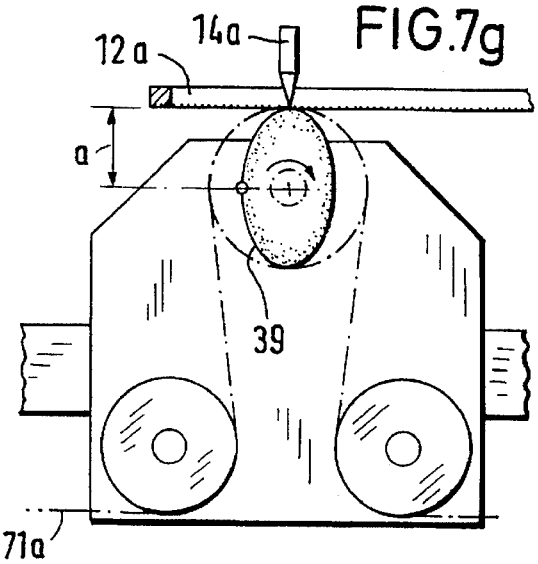
Figure 7H:
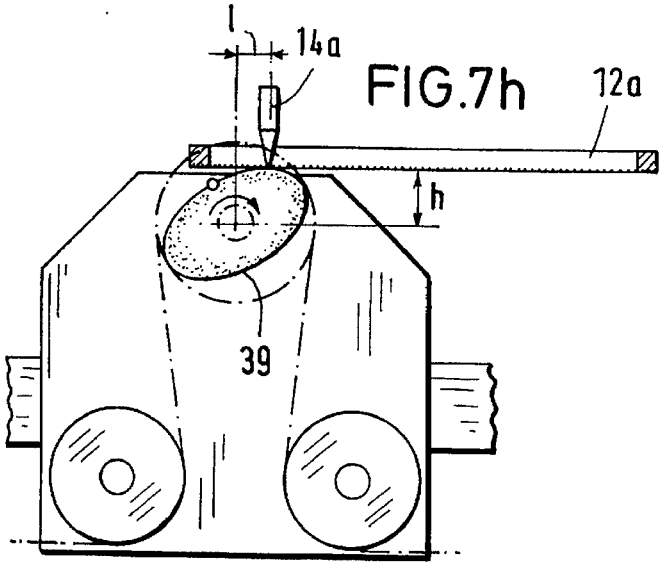
Figure 7I:
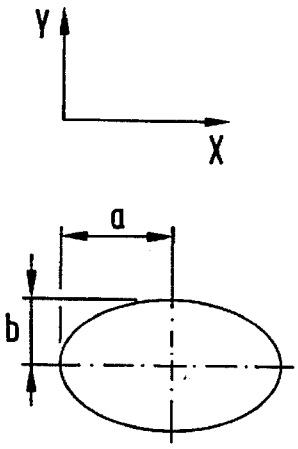
Figure 7I:
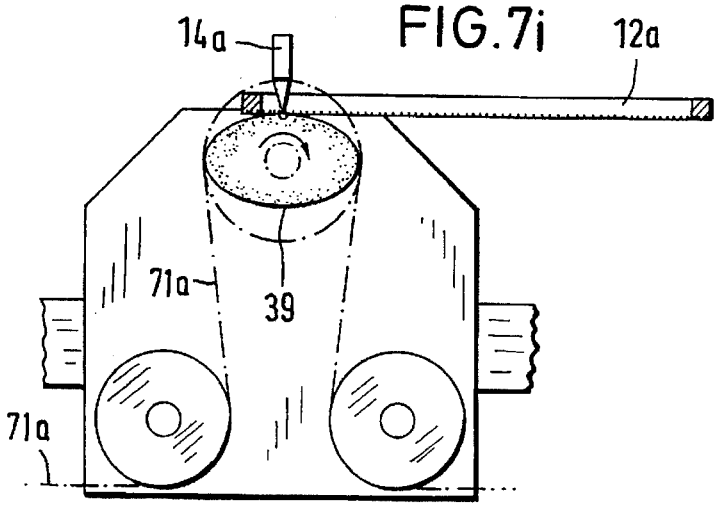

In the course of the pivotal movement of the article from the position shown in FIG. 7*d* into that shown in FIG. 7*e*, in which the article 39 assumes a position of being pivoted through 180° in comparison with the FIG. 7*a* position, the carriages 48*a*, 48*b* are moved back again into the starting position of FIG. 7*a* so that when the position of FIG. 7*e* is reached, the squeegee is again disposed above the longitudinal axis of the article and in a position of prolongation of the shorter cross-sectional axis thereof, and the longitudinal axis of the article and the longitudinal axis of the transfer region again coincide. At the same time, during that phase of the pivotal movement, the printing mechanism can be moved downwardly, to follow the downwardly moving transfer region.

FIGS. 7*f–i* show the sequence of movements involved in printing on the other side of the article. Those movements correspond to those of FIGS. 7*a–e* so that, at the end, all parts again assume the starting position shown in FIG. 7*a*. In the case of the illustrated embodiment however this is to be attributed to the fact that the article 39 is printed upon, over a region of 360°. It will be appreciated that it is also possible and indeed usual for printing to be applied to the article only over a part of its periphery. In this case the pivotal movement of the article, the vertical movements of the screen printing stencil and the squeegee and the lateral displacement of the carriages 48*a*, 48*b* could be effected only to the extent that is required by the print image to be produced. Thus for example when printing on an article over one half of its periphery, the sequence of movements could be terminated when reaching the position shown in FIG. 7*e*.

Although the regions to be printed upon, on the articles illustrated in both embodiments, are not of a circular cross-section, they are of a regular configuration insofar as the respective region to be printed upon is of an elliptical cross-section with two axes of symmetry. It will be noted that the invention is in no way restricted to printing on articles of a regular cross-sectional shape of that kind. It is thus possible also to print on articles whose region which is to bear printing is of an irregular cross-section and for example includes a flat surface. It is also possible to apply printing to articles which for example are of a substantially square or rectangular cross-section, in which case the edges are rounded off and the regions between two adjacent edges are curved somewhat outwardly. It would however also be possible to print on such articles with rounded-off edges, when the surface between two adjacent edges is completely flat and is therefore not curved.

When printing on surfaces which are of circular cross-section or which form a portion of a curve, there is no need for the above-described movements of the article in the directions of the X-axis and the Y-axis.

In the embodiment shown in FIGS. 1 through 4 a station VI in which the article or bottle to be printed upon is put into the holder 43*a*, 43*b* or 44*a*, 44*b*, and a station VII in which the printed article or bottle is removed from the respective holder are associated with the lower portion 53*b* of the path of transportation movement. The operation of introducing the article or bottle into the holder in the receiving station VI is performed by means of a gripper 79*a* which is movable in three dimensions and which receives the bottle or article which is supplied thereto by a conveyor 97*a*, then by means of mutually superimposed pivotal movements, moving the article or bottle from a vertical position into a horizontal position and in so doing moving it into the receiving station VI in which it is picked up by the two portions of the respective holder at that location. It is known for the two holder portions carrying the article to be so arranged that the spacing between them can be altered so that the two holder portions can receive and hold the article to be printed upon, in order subsequently to be able to release the printed article. In the illustrated embodiments, only the holder portion 43*b*, 44*b* co-operating with the neck end of the bottle article 39 is arranged in the respectively associated carriage 48*b*, 50*b*, in such a way as to be displaceable parallel to the longitudinal axis of the article carried by the holder portions. For that purpose the holder portion 43*b*, 44*b* is provided with a cam roller as indicated at 101 for example in FIG. 2 which, in the receiving station VI and in the removal station VII, co-operates with a cam portion 103 which extends parallel to the direction of transportation movement of the article in the region of the above-mentioned stations. The cam portion 103 is displaceable transversely to the direction of transportation movement by a pneumatic piston-cylinder arrangement indicated at 105 in FIG. 2. In the course of the movement of the holder portions in the direction of the arrow 17 (FIG. 1) into the removal station VII the cam roller 101 on the respective holder portion 43*b* or 44*b* passes into the cam configuration of the cam portion 103. After the removal station VII is reached the gripper 79*b* is moved along a rail 99*b* into a limit position which is at the left in relation to the view shown in FIG. 1 and is pivoted into the removal station in order to grip the article which is disposed there and which is still being carried by the respective holder portions. Thereupon, by suitable actuation of the piston-cylinder unit 105, the holder portion 44*b* is moved away from the holder portion 44*a* by a distance which is sufficient for the article now carried by the gripper 79*b* to be released at its neck end. Thereupon the gripper 79*b* performs a short movement towards the holder portion 44*b* at the neck end of the article in order to move the article out of engagement with the holder portion 44*a* which carries the bottom of the article. The gripper 79*b* with the article can then be moved along the rail 99*b* towards the conveyor 97*b* and pivoted in such a way that it puts the printed article in an upright position on to the conveyor 97*b*, as shown in FIG. 1. The holder 44*a*, 44*b* can then be advanced into the receiving station VI, in which case the holder portion 44b maintains its position in which it is at its greater spacing from the holder portion 44a so that, after the receiving station VI is reached, the gripper 79a firstly moves an article which it has previously taken from the conveyor 97a in a horizontal position into place between the two holder portions 44a, 44b and then inserts the bottom region of the article into the holder portion 44a, by suitable movement parallel to the longitudinal axis of the article. Then, the piston-cylinder unit 105 at the receiving station VI is operated so that the cam portion 103 at that point is displaced towards the holder portion 44a, entraining the cam roller 101 which is disposed in the cam configuration of that cam portion 103, with the result that the holder portion 44b engages into the neck of the article 39 so that the latter is now carried by the two holder portions. The gripper 79a can now come free from the holder portion and can be moved back into the position for receiving the next article.

In the course of the stepwise advance transportation movement of the article now carried by the holder 44a, 44b, in the lower portion 53b of the path of transportation movement in the direction of the arrow 18, the cam roller 101 comes out of engagement with the cam portion 103. After reaching the upper portion 53a of the path of transportation movement in the direction of the arrow 18 the article can be subjected to any additional treatments, before reaching the first printing station I. The article can be treated to remove dust therefrom, it can be subjected to a flame treatment, and it can be oriented in a peripheral direction. After the preliminary treatment the article is then moved into the first printing station I in which the parts assume the position described in connection with FIG. 7a, immediately prior to the beginning of the printing operation. After termination of the printing procedure in the printing station I the article is then transported into the printing station II in which the next print image is applied. After the last print image has been applied in the station IV the article, after passing through the portion 53c of the path of transportation movement, then again passes into the lower portion 53b and there into the removal station VII in which the article is removed from the holder by the gripper 79b, in the manner already described above.

Because the two holders 43a, 43b and 44a, 44b are moved independently of each other along the transportation path, it is possible, for example after the last print image has been applied, for the article to be moved immediately into the removal station VII and, after the printed article has been removed from the holder, for the holder to be advanced immediately into the receiving station VI in order there to receive the next article. There is further the possibility that all desired treatments can be carried out in the treatment stations which are optionally disposed between the receiving station VI and the printing station I, without this being impeded or delayed by the transportation movement of the other holder or holders. That achieves a considerable increase in productivity in comparison with previous machines.

Referring now to FIGS. 8 through 11, the embodiment described with reference thereto is substantially the same as the embodiment shown in FIGS. 1 through 4 so that parts which are the same or correspond to each other are denoted by the same references but increased in each case by 100 in FIGS. 8 through 11. From the printing procedure point of view, the essential difference between the two embodiments is that the screen printing stencils 112a, 112b, 112c, 112d and 112e of the five printing mechanisms are arranged stationarily insofar as, during a printing operation, they do not perform any movements parallel to the main plane thereof, that is to say in the direction of the X-axis. Instead, the squeegees 114a, 114b, 114c, 114d and 114e are arranged reciprocably substantially parallel to the main plane of the respectively associated screen printing stencil and perpendicularly to the longitudinal axis of the article to be printed upon, in order to produce the relative movement required for the printing operation, as between the screen printing stencil and the associated squeegee.

In this embodiment also, each of the printing mechanisms comprising the screen printing stencil and the squeegee is arranged to be vertically movable up and down so that, when dealing with articles whose surface to be printed upon differs in cross-section from the configuration of a circle or a portion of a circle, it is possible to follow the variations in the position in respect of height of the transfer region of the article which bears against the screen printing stencil, such variations in height occurring in the course of the pivotal movement by the article. For that purpose there is an NC-motor 122 driving a shaft 124 on which are fixed two toothed belt wheels 126 each engaged with a respective vertical toothed belt 128. Arranged above the two wheels 126 at a spacing therefrom are two toothed belt wheels 132, each of which serves to guide one of the toothed belts 128. Each of the two toothed belts 128 is connected by way of a respective transverse portion 109 to a carriage 125 guided on vertical guides 121 fixed to the machine frame structure 119. All screen printing stencils 112a–112e are mounted on the carriage 125. The carriage 125 is further provided with two substantially horizontal guides 115 which extend at a spacing from each other and on which a carriage 116 is substantially horizontally reciprocable. The carriage 116 carries all squeegees 114a–114e by way of cantilever arms 131. The reciprocating movements of the squeegee-carrying carriage 116 are produced by an NC-motor 138 which drives a toothed belt wheel 140 by way of a shaft comprising two telescopically co-operating shaft portions 141 and 145. A toothed belt 142 is guided around the toothed belt wheel 140 and around a second toothed belt wheel 149 arranged at a horizontal spacing. The two wheels 140 and 149 are disposed on a carrier 151 which is mounted on the carriage 125 at the rear side thereof. Accordingly the two wheels 140 and 149 and the toothed belt 142 which is reciprocable in the horizontal plane participate in the upward and downward movements of the carriage 125, while the variations in the spacing between the NC-motor 138 and the toothed belt wheel 140 are made possible by virtue of the telescopic cooperation of the two shaft portions 141, 145. The toothed belt 142 and the carriage 116 guided on the guides 115 are connected together by at least one transverse portion 159 so that the reciprocating movements of the carriage 116 in a horizontal plane, with the squeegees carried on the carriage 116, are produced by the toothed belt 142.

Figure 8:
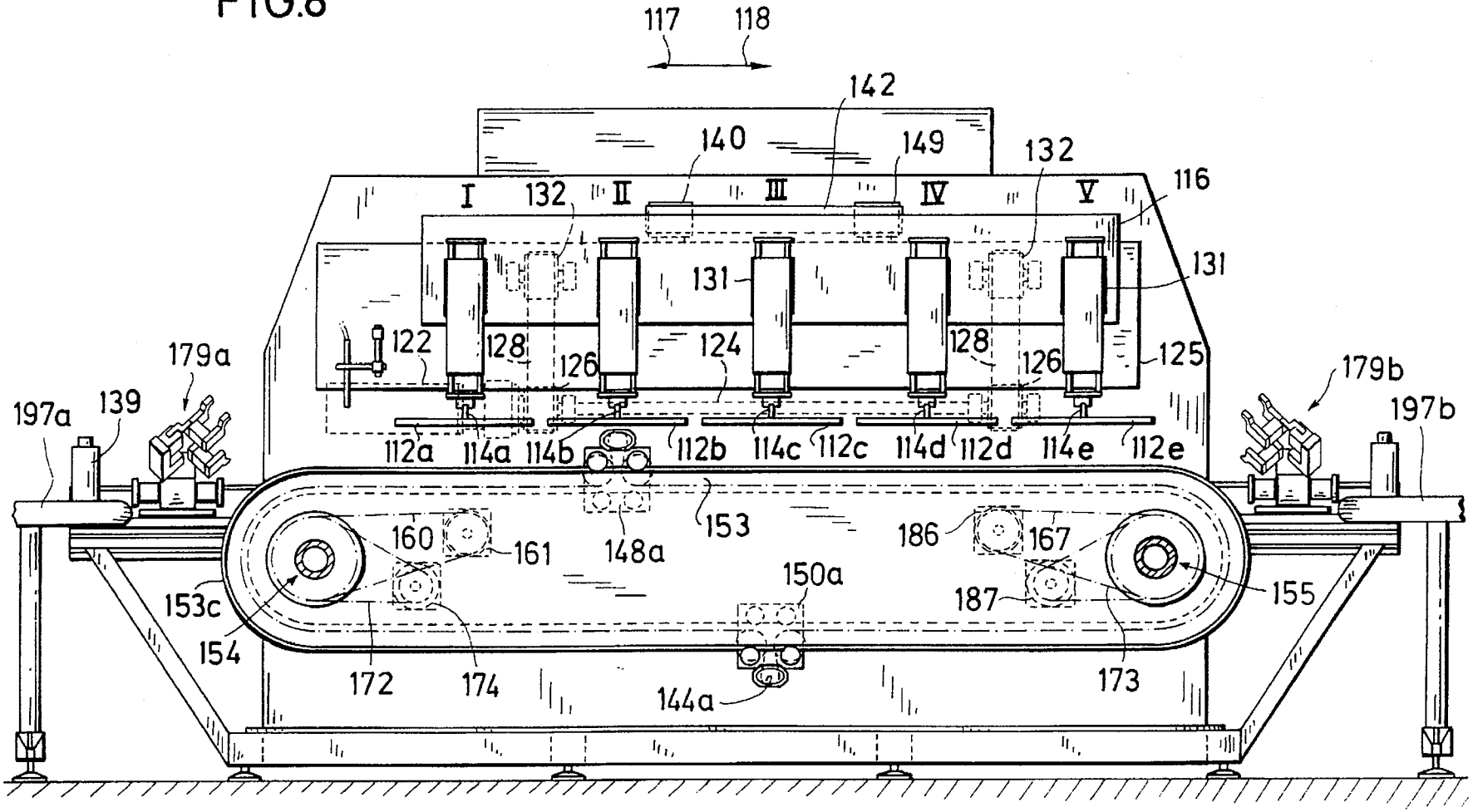
FIG. 8 is a view corresponding to FIG. 1 of a second embodiment.
Figure 9:
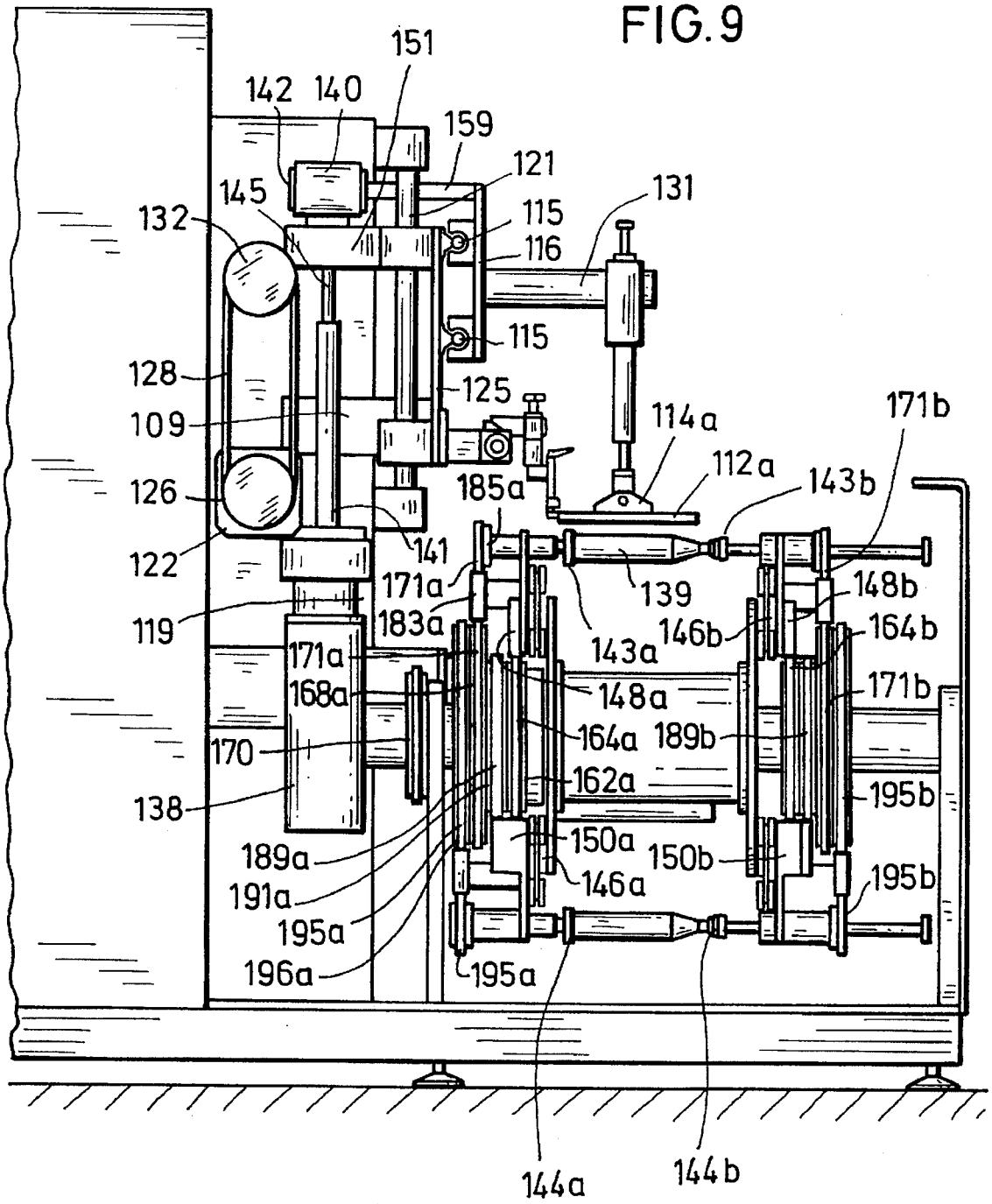
FIG. 9 is a view corresponding to FIG. 2 of the second embodiment.
Figure 10:
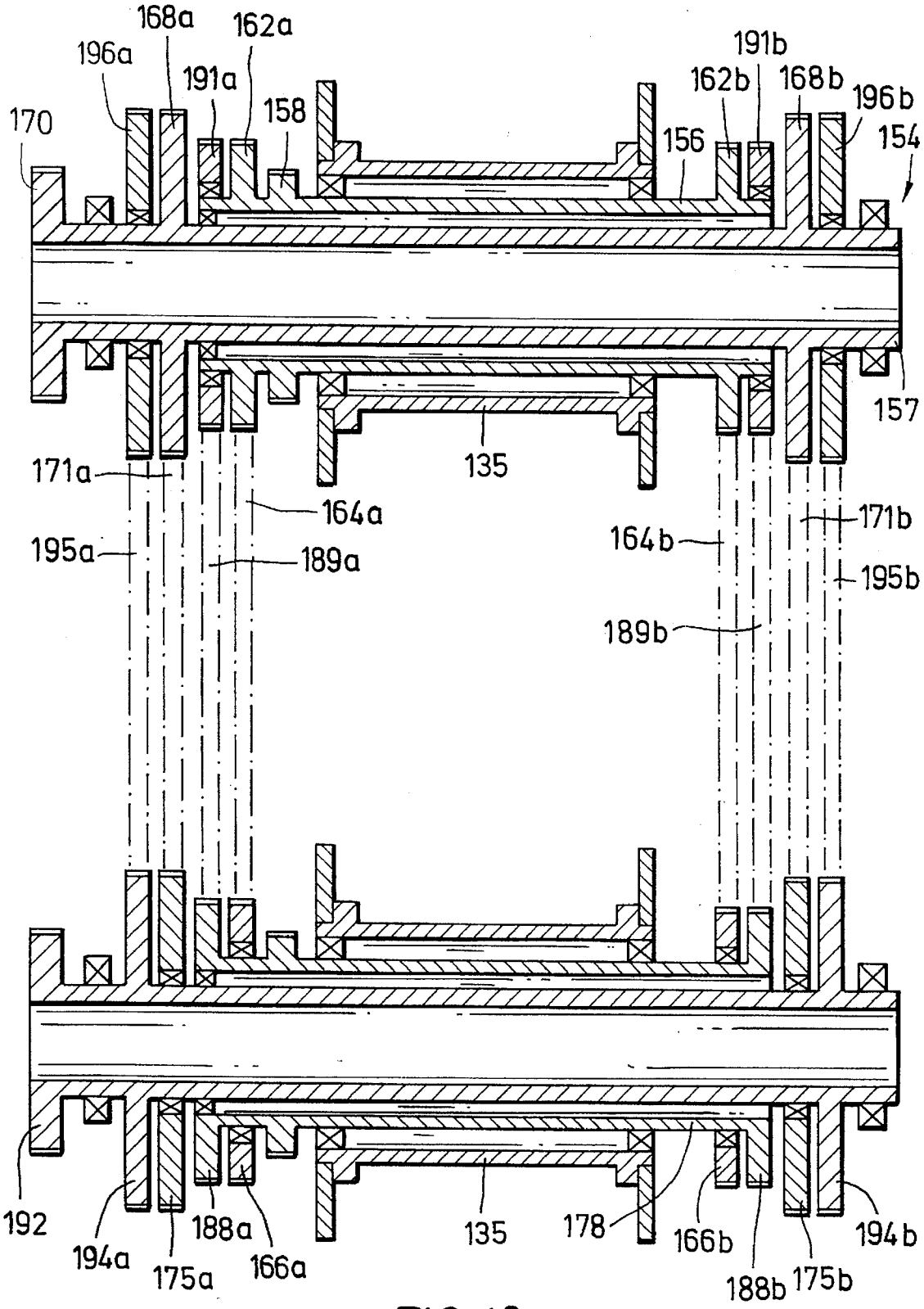
FIG. 10 is a view corresponding to FIG. 4 of the second embodiment.

The embodiment shown in FIGS. 8 and 9 is in principle the same as that shown in FIGS. 1 and 2, in regard to the means for transporting and pivoting the holders for the articles 139, and the drives which are required for that purpose. In this respect attention is directed in particular to FIG. 10 showing the arrangement of the shaft sets and the individual toothed belt wheels carried thereby, with the toothed belts. In FIG. 10 also all parts corresponding to parts of the embodiment described above with reference to FIGS. 1 through 4 are denoted by the same references but increased in each case by 100. The arrangement shown in FIG. 10 permits the construction to be somewhat more compact than the arrangement shown in FIG. 4.

Figure 11A:
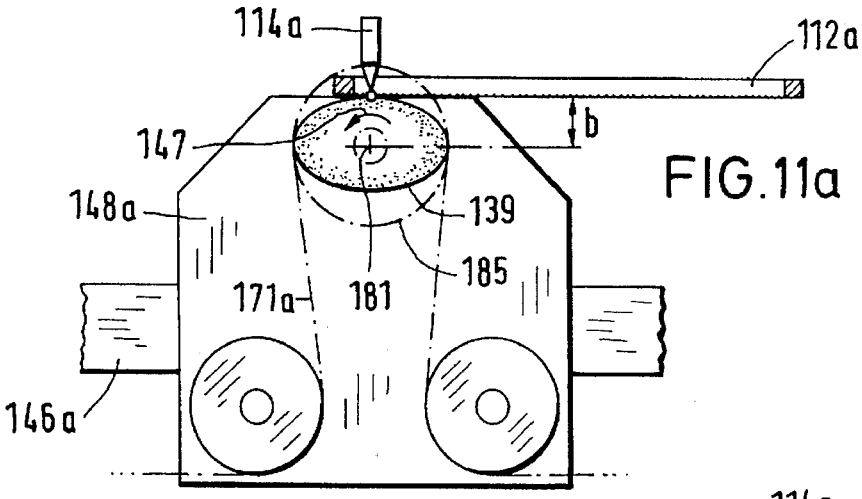
FIGS. 11*a–i* show the operating procedure of the printing operation performed in the second embodiment.
Figure 11B:
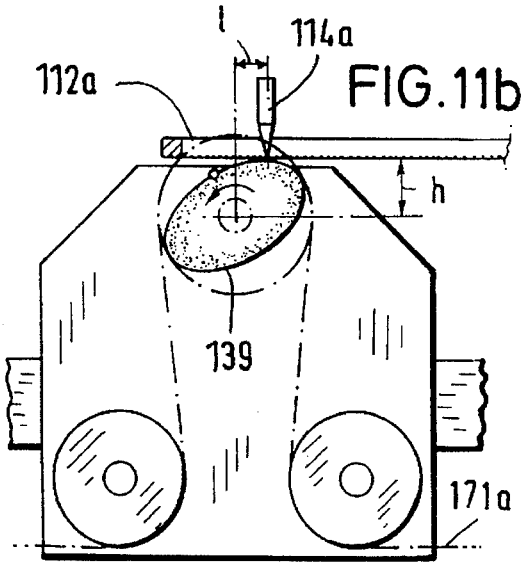
Figure 11C:
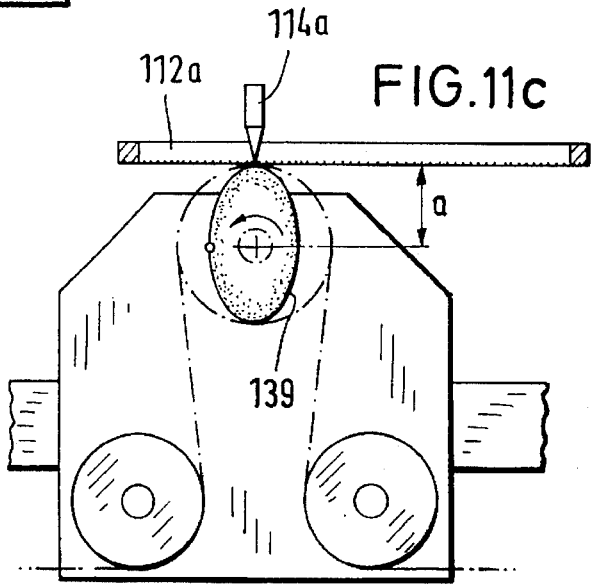
Figure 11D:
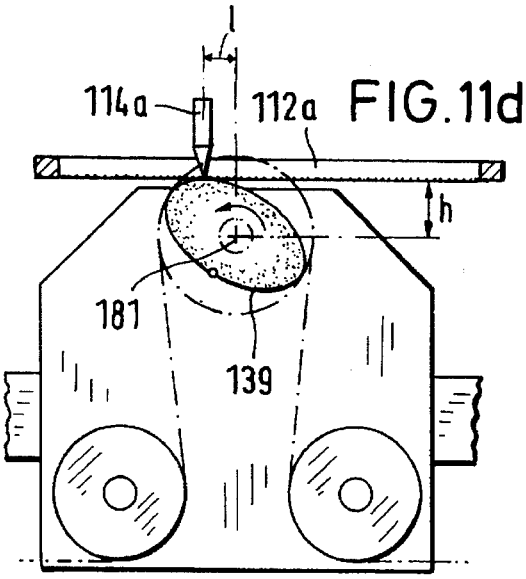
Figure 11E:
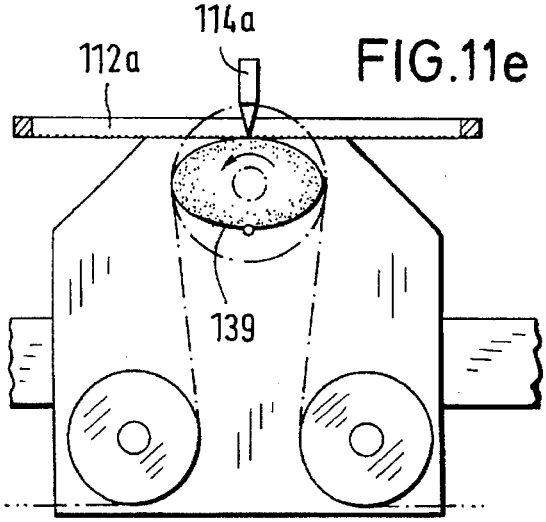
Figure 11F:
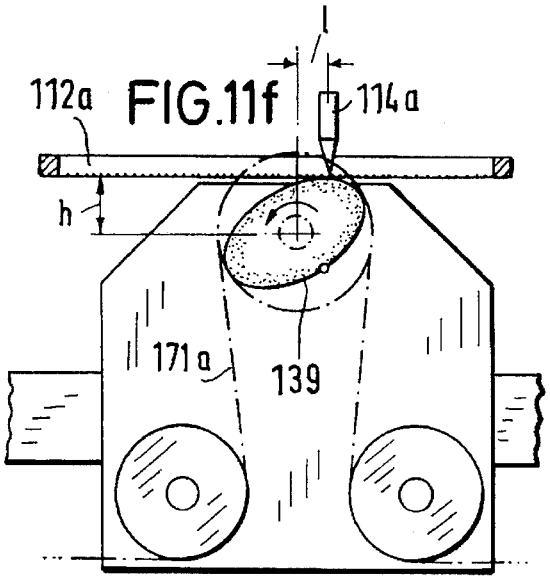
Figure 11G:
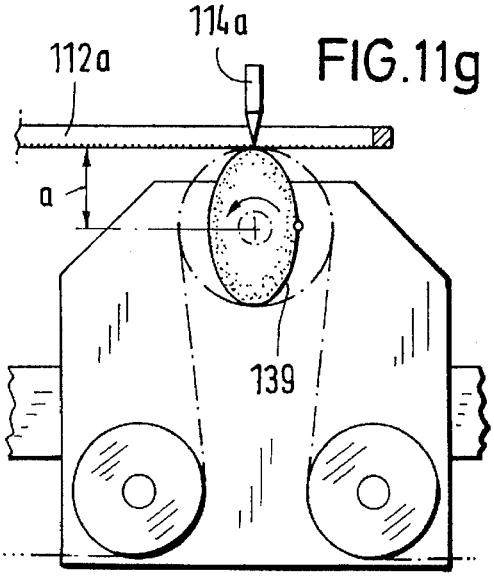
Figure 11H:
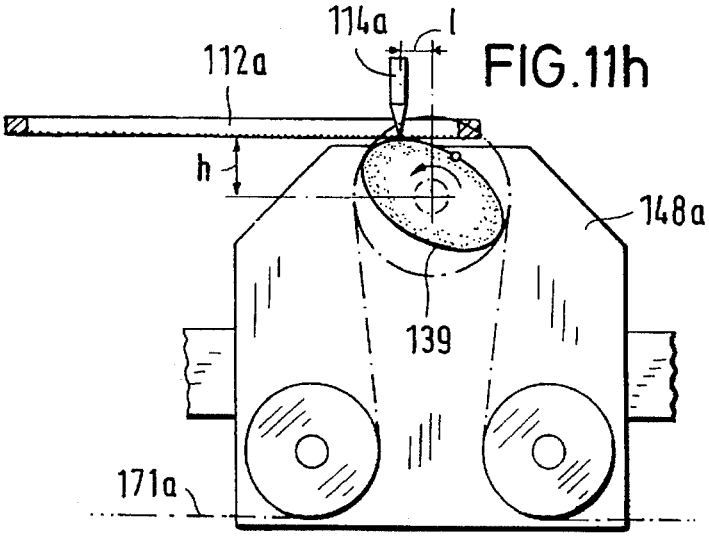
Figure 11I:
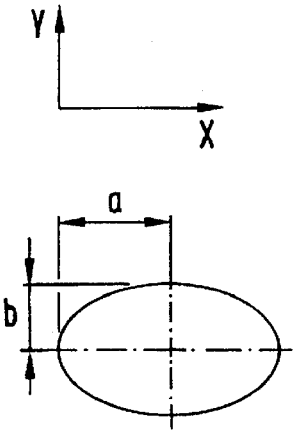
Figure 11I:
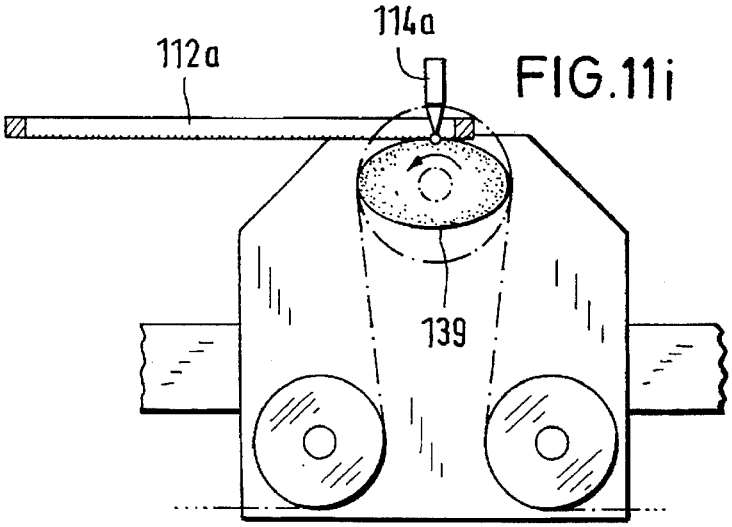

FIGS. 11a–i, similarly to the views in FIGS. 7a–i, show the sequence of movements of the parts which co-operate in the printing operation when the screen printing stencil is stationary in parallel relationship with the X-axis and the squeegee is arranged displaceably parallel to the X-axis. In that respect it is necessary for the article 139 to be moved in the direction of the X-axis during the printing operation so that the surface regions of the article, which are to be printed upon, are rolled against the screen printing stencil. That movement is transmitted to the article 139 by way of the holder portions 143*a*, 143*b* carrying the article, by the NC-motor 161 driving the two toothed belts 164*a*, 164*b* to which the two carriages 148*a*, 148*b* for the holder portions are connected. As however the apparatus shown in FIGS. 8 and 9 is also used for printing upon an article whose surface to be printed upon is of a cross-section which deviates from a circular shape, in this case also there is a necessity for the article to be additionally displaced in the direction of the Y-axis in order to provide that the above-defined transfer region of the article 139 extends substantially tangentially relative to the screen printing stencil and the squeegee is disposed substantially perpendicularly over the central axis of the transfer region. If the squeegee, in the course of the printing operation, is moved at a constant speed relative to the screen printing stencil which is stationary in the direction of the X-axis, for example from the position shown in FIG. 11*a* into the position shown in FIG. 11*b*, it is necessary that superimposed on the simultaneous transportation movement of the article in the same direction, there is a second movement. For that purpose the motor 161 is so progranted that a resulting movement is produced, in which, when the position shown in FIG. 11*b*, the squeegee is not above the central axis 181 of the cross-section of the article to be printed upon, but is displaced towards the right relative to that center point, as viewing FIG. 11*b*, in order to satisfy the above-indicated condition that the squeegee is disposed above the center point or above the central axis which is associated with the radius of curvature of the transfer region of the surface of the article. In the specific case considered here, that means that the movement of the article between the two positions shown in FIGS. 11*a* and 11*b* trails somewhat relative to the movement of the squeegee in the same direction, more specifically trailing by the distance indicated at 'l' in FIG. 11*b*. In FIG. 11*c* the squeegee is again disposed precisely over the central axis of the cross-section of the article, which at that time is also the central axis of the transfer region, so that accordingly the movements of the article and the squeegee in the direction of the X-axis—once again in dependence on the cross-sectional shape of the region to be printed upon—take place at different resulting speeds in such a way that, in this phase of the printing operation, the squeegee is accordingly moved somewhat slower in the direction of the X-axis, than the article. In the next phase of the printing operation, that is to say in the movement of the co-operating parts from the position shown in FIG. 11*c* into that of FIG. 11*d*, the squeegee and the article are again moved in dependence on the cross-sectional shape of the surface region to be printed upon in this phase, at different speeds of motion, in such a way that the article leads by the distance indicated at 'l' in FIG. 11*d*, said distance corresponding to the distance on the X-axis between the axis 181 about which the article is rotated and the position of the squeegee. In the next phase of the printing procedure, at the end of which the parts assume the positions shown in FIG. 11*e*, the article is again moved in the direction of the X-axis more slowly than the squeegee so that finally the squeegee is above the axis of rotation 181 of the article.

FIGS. 11*f–i* show the sequence of movements when printing on the other side of the article 139. The movements here are the same as the sequence of movements described with reference to FIGS. 11*a–e*.

Corresponding considerations therefore also apply in regard to the holder portions 144*a* and 144*b* and the article carried thereby.

The joint vertical movements of the screen printing stencil and the squeegee are the sate as those of the first embodiment, as described with reference to FIGS. 7*a–i* as the cross-sectional shapes of the articles are also the same.

In the embodiment shown in FIGS. 8 and 9 the two stations in which the articles to be printed upon are fitted into the holders and the printed articles are removed from said holders are associated with the upper portion 53*a* of the path of transportation movement, whereas in the case of the embodiment described with reference to FIGS. 1 and 2 those stations are associated with the lower portion 53*b*. Which of those two options is preferably adopted depends on the respective factors and parameters involved, for example whether any preliminary treatments are to be carried out in the region of the transportation path 53*c* or 153*c* respectively, before the first printing operation is carried out. Moreover, in the case of the apparatus described with reference to FIGS. 8 and 9, disposed upstream of the first printing station I in the region of the upper portion 153*a* of the transportation path is a further station in which the articles are suitably oriented and aligned in the peripheral direction.

When printing on articles which, after the printing operation, required a particular treatment for drying the printing ink, the stations II and IV of the apparatus shown in FIGS. 8 and 9 can be replaced by respective drying devices, for example UV-radiating devices, which, when the articles are transported from the one printing station to the respective following printing station, can possibly be moved substantially synchronously with said articles if that enhances the level of productivity of the machine.

Depending on the desired level of production per unit of time it is also possible to provide the apparatus with more than first and second holders.

In many cases the operation of applying the individual print images is effected in such a way that a respective printing operation is performed only in one of all of the printing stations provided, whereas the other stations are in an idle condition. Depending on the cross-sectional shape of the article region to be printed upon, when there are for example two holders, printing operations can be carried out simultaneously in two stations if the vertical movements of the printing mechanisms in the two stations are the same.

It is further possible for at least one of the printing stations to be of a different design configuration, for example in such a way that the screen printing stencil is stationary and the squeegee is moved transversely to the transport direction 18 relative to the screen printing stencil, for applying the printing ink or color to the article. Such an arrangement may be desirable for example when the article has a substantially flat surface portion to which printing is to be applied. In that case the screen printing stencil and the article do not need to be moved relative to each other during the printing operation.

It will be appreciated that it is also possible for the holder portions to be mounted on the respective carriages in such a way as to be vertically movable up and down in order to compensate for the variations in vertical distance between the transfer region and the axis of rotation of the article, such variations occurring in dependence on the cross-sectional shape of the article, so that the printing mechanisms could then be arranged stationarily in the vertical direction. The vertical mobility of the printing mechanisms, as is provided in beth of the embodiments illustrated in the drawing, will however result, in many cases, in less complicated and more clearly defined movements in the individual printing stations. In every case, that is to say irrespective of which parts perform the vertical movements, the essential advantage of the apparatus in accordance with the present invention and the process for applying printing to individual articles as for decorative purposes is still enjoyed, namely that, when changing from one kind of article to another, which also requires a change in the holder portions and possibly also different movements of the co-operating parts, only the actual holder portions need to be replaced. All other components, from the drives through to the toothed belt wheels and the carriages, can be retained as they are. There is only a need for the program which controls the motors to be adapted to the new article.

It will be seen therefore that the process of the invention involves a screen printing procedure for applying printing to individual articles, as for decoration purposes, each article being held during the printing operation by a holder which is transported intermittently through the treatment stations. Each holder is operable to transmit a rotational movement to the holder and thus the article held thereby. Each holder is transported independently of the at least one other holder and each holder is rotated at least during the printing operation, independently of the at least one other holder. During the printing operation, when printing on surfaces which deviate from the shape of a circular arc, the article is moved by suitable transport devices in the transport direction and/or in the opposite direction thereto, in dependence on its cross-sectional shape, in order thereby to hold the article, in dependence on the cross-sectional shape of its transfer region, in the appropriate position relative to the squeegee, this being the position which is required for the printing operation and in which the squeegee extends substantially perpendicularly over the central axis of the transfer region of the article, on to which the respective printing ink is to be transferred.

It will be appreciated that the above-described process and apparatus according to the principles of the present invention have been set forth solely by way of example and illustration of the invention and that other modifications and alterations may be made therein without thereby departing from the spirit and scope of the invention.

What is claimed is:

1. Apparatus for printing on articles, including: at least first and second holders for the articles; means rotatably mounting the holders; an introduction station at which articles are introduced into the respective holders; a removal station at which the articles are removed from the respective holders; at least one printing mechanism having a screen printing stencil, a squeegee and a drive means for producing relative movement between the screen printing stencil and the squeegee, for printing on articles carried by the holders; a transport means for the holders, for transporting the articles held by the holders between the introduction station and the removal station; and for each holder a separate drive for the transport means and a separate drive with transmission means for transmitting the rotary movement to the respective holder, the drive means for the transport means and for the transmission means and the drive means for producing the relative movement between the screen printing stencil and the squeegee being in the form of CNC-motors.

2. Apparatus as set forth in claim 1 wherein for printing on articles whose surface to be printed upon deviates from at least particular shape the holder carrying the article is laterally displaced by the transport means associated with said holder in order to hold the article, in dependence on the cross-sectional shape of its region to be printed upon, in the position required for the printing operation relative to the squeegee, in which position the squeegee extends substantially perpendicularly over the central axis of the transfer region of the article on to which the respective printing is to be applied.

3. Apparatus as set forth in claim 1 wherein the screen printing stencil of the at least one printing mechanism is adapted to be laterally stationary during a printing operation and the squeegee moves laterally relative to the screen printing stencil for applying a print image to the article, said transport means being adapted to transmit to the article the movement required for rolling the article against the screen printing stencil for the purposes of applying the printing to the article.

4. Apparatus as set forth in claim 1 wherein the squeegee of the at least one printing mechanism is adapted to be laterally stationary during a printing operation and the screen printing stencil is adapted to be laterally displaced relative to the squeegee for applying printing to the article.

5. Apparatus as set forth in claim 1 including means mounting the screen printing stencil and the squeegee of the at least one printing mechanism movably upwardly and downwardly jointly, and CNC-drive means for producing said upward and downward movements to compensate for vertical displacement of the region of the article to which printing is to be applied, which occurs when printing on articles of non-circular cross-section.

6. Apparatus as set forth in claim 1 wherein the transport means comprises at least one toothed belt connected to the associated holder.

7. Apparatus as set forth in claim 1 wherein the transmission means comprises at least one toothed belt co-operable with a tooth configuration at the associated holder.

8. Apparatus as set forth in claim 1 including first and second shaft sets each comprising a plurality of shafts rotatable about a respective common axis, the axes of the shaft sets being arranged at a spacing from each other, and further including wheels carried on the shafts for driving and for guiding the transport means and the transmission means respectively.

9. Apparatus as set forth in claim 6 wherein each holder comprises first and second holder portions, and further including a transport means and a transmission means for each holder portion, wherein the two transport means and the two transmission means for the holder portions of the respective holder are each drivably connected to the same respective CNC-motor.

10. Apparatus as set forth in claim 7 wherein each holder comprises first and second holder portions, and further including a transport means and a transmission means for each holder portion, wherein the two transport means and the two transmission means for the holder portions of the respective holder are each drivably connected to the same respective CNC-motor.

11. Apparatus as set forth in claim 1 including a common carrier for all screen printing stencils.

12. Apparatus as set forth in claim 1 including a common carrier for all squeegees.

13. Apparatus as set forth in claim 1 including: a carrier for the at least one screen printing stencil; a carrier for the at least one squeegee; means positively lockingly connecting the carriers together in the vertical direction; and means connecting the carriers together in such a way that the two carriers are operable to perform reciprocating movements relative to each other in the printing direction and in the opposite direction thereto.

* * * * *